US009615671B1

(12) United States Patent
Janay

(10) Patent No.: US 9,615,671 B1
(45) **Date of Patent: *Apr. 11, 2017**

(54) PLAY PLATFORM

(71) Applicant: Cindy Janay, Stafford, VA (US)

(72) Inventor: Cindy Janay, Stafford, VA (US)

(73) Assignee: Cindy Janay, Swansboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/716,375

(22) Filed: May 19, 2015

Related U.S. Application Data

(63) Continuation of application No. 13/736,070, filed on Jan. 8, 2013, now Pat. No. 9,044,688.

(60) Provisional application No. 61/631,819, filed on Jan. 9, 2012.

(51) Int. Cl.

| | |
|---|---|
| ***A47B 23/00*** | (2006.01) |
| ***A47D 3/00*** | (2006.01) |
| ***A63H 33/00*** | (2006.01) |
| ***A47B 3/00*** | (2006.01) |

(52) U.S. Cl.
CPC ..... *A47D 3/00* (2013.01); *A47B 3/00* (2013.01); *A63H 33/00* (2013.01)

(58) Field of Classification Search
CPC A61G 2007/0519; A47C 21/00; A47D 1/008; A47B 23/00; A47B 23/04; A47B 13/16; A47B 37/00; A47B 41/00; A47B 3/06; A47B 25/00
USPC ..... 108/25, 26, 43, 64; 5/503.1, 507.1; 220/500; 312/107, 257.1, 249.8, 249.9, 312/249.11, 249.12, 249.13; 206/600, 206/565
See application file for complete search history.

(56) References Cited

U.S. PATENT DOCUMENTS

| | | | | |
|---|---|---|---|---|
| 2,008,078 A * | 7/1935 | Martin | ..... | A47B 25/00 108/26 |
| 2,170,093 A * | 8/1939 | Pringle | ..... | B41L 5/08 267/174 |
| 2,565,823 A | 8/1951 | Pool | | |
| 2,596,094 A | 5/1952 | Berman | | |

(Continued)

FOREIGN PATENT DOCUMENTS

| | | |
|---|---|---|
| CA | 817148 | 7/1969 |

OTHER PUBLICATIONS

Build n' Learn Table, Shopping website: www.megabloks.com.

(Continued)

*Primary Examiner* — Jose V Chen
(74) *Attorney, Agent, or Firm* — Polsinelli LLP

(57) ABSTRACT

The legless, planar, rectangular platform may consist of a top that will be the primary play surface. In addition to the rectangular platform, additional members may be included. A front member may be attached to the primary platform and may run along the width of the invention. A second member, considered one side of the invention, may be attached in like manner to the primary platform as the front member, as well as being attached at a 90 degree angle to the front member with slots for drawers. The four members when attached together may form a rectangular shaped structure to which the primary flat member is attached. Removable bins may also be included. Each bin may attach along the periphery of the primary flat platform for ease of access and secure storage. Each bin may be comprised of five (5) members; a bottom and four (sides).

14 Claims, 4 Drawing Sheets

(56) References Cited

U.S. PATENT DOCUMENTS 2,695,830 A 11/1954 McCorkle
2,707,141 A * 4/1955 Witter ..... A47B 13/16 108/26
2,763,522 A 9/1956 Berman
3,003,839 A * 10/1961 Bloom ..... A47B 87/0207 206/512
3,123,935 A * 3/1964 Williams ..... A47B 13/16 108/116
3,167,371 A * 1/1965 Parcher ..... B42F 17/343 273/149 P
3,652,051 A 3/1972 McFarlane
3,730,604 A * 5/1973 Viera ..... H04M 1/21 312/223.4
4,513,974 A * 4/1985 Lin ..... A63F 3/0023 206/579
D291,037 S 7/1987 Handler et al.
4,717,024 A * 1/1988 Djezovic ..... A45C 5/005 150/119
4,872,410 A 10/1989 Lilly
4,874,209 A 10/1989 Spitzer
4,926,758 A 5/1990 Lilly
4,944,402 A * 7/1990 Wu ..... A45D 33/20 132/287
4,957,235 A * 9/1990 Beno ..... B26D 1/30 108/25
5,055,081 A 10/1991 Nayak
5,172,642 A * 12/1992 Iannuzzelli ..... A47B 7/02 108/25
5,218,912 A 6/1993 Buske
5,327,838 A * 7/1994 Beltman ..... A47B 25/00 108/25
D350,247 S 9/1994 Buske
5,460,102 A * 10/1995 Pasmanick ..... A47B 23/002 108/25
5,509,844 A 4/1996 Poirier
5,615,619 A 4/1997 King
D387,583 S 12/1997 Shear
5,692,815 A * 12/1997 Murphy ..... G06F 3/0395 108/26
5,782,185 A 7/1998 Frahm
5,979,337 A * 11/1999 Clark ..... A47B 23/06 108/23
6,050,200 A * 4/2000 Sullins ..... A47B 23/002 108/25
6,082,272 A 7/2000 Adrain
6,164,213 A * 12/2000 Topps ..... A47B 21/0314 108/25
D464,089 S 10/2002 Studebaker
6,595,607 B2 * 7/2003 Morgan ..... A47B 67/04 312/294
6,785,920 B1 9/2004 Amador, Jr.
6,928,932 B1 * 8/2005 Ferrill ..... A47B 37/00 108/23
7,107,913 B2 * 9/2006 Smith ..... E04F 15/02411 108/64
D534,215 S * 12/2006 Nakata ..... D19/113
7,510,479 B2 * 3/2009 Stengel ..... A63H 33/32 108/25
D624,606 S 9/2010 Carmack
8,316,781 B1 * 11/2012 Majors ..... 108/158.12
8,347,790 B1 * 1/2013 Maiers ..... A63F 1/067 108/25
8,490,551 B1 * 7/2013 Wagner ..... A47B 31/04 108/24
D712,175 S 9/2014 Choi
9,044,688 B1 * 6/2015 Janay ..... A63H 33/04
2005/0110309 A1 5/2005 Cziraky
2007/0056482 A1 * 3/2007 Robinson ..... A47B 3/06 108/25
2013/0192498 A1 8/2013 Bullock et al.
2013/0264847 A1 10/2013 Pugh

OTHER PUBLICATIONS

U.S. Appl. No. 13/736,070 Office Action mailed Dec. 11, 2014.
U.S. Appl. No. 13/736,070 Final Office Action mailed May 29, 2014.
U.S. Appl. No. 13/736,070 Office Action mailed Feb. 10, 2014.

* cited by examiner

PLAY PLATFORM

CROSS-REFERENCE TO RELATED APPLICATIONS

The present application is a continuation and claims the priority benefit of U.S. patent application Ser. No. 13/736,070, filed Jan. 8, 2013, which claims the benefit of U.S. provisional patent application No. 61/631,819, filed Jan. 9, 2012, the disclosures of which are incorporated by reference herein.

BACKGROUND OF THE INVENTION

Lego-type projects range from small to large and can take a few minutes to weeks, or even months to build. The most reasonable space for building larger projects is on a large table since it is a hard surface that provides ample space to spread out the project. But, occupying the kitchen or family table for the extended period of time that it takes to build a larger project may not be an option if the home has limited table space. Additionally, regardless of the size of the project, when removing the unfinished project from a table that must be used for other purposes, the child must place all their Legotype toys elsewhere, losing the structure that they had when all the pieces were laid out organized on the table.

Another space for building these projects is on the floor. The floor allows room to spread out, but if carpeted, building on it may not make for a securely built project since Lego-type toys have to be firmly squeezed together to be solid. Additionally, building on the floor also makes the room a mess until the project is completed, especially if it is a large project. During this time, the floor is filled with Lego-type toys, which can be an inconvenience in a tiny room.

In addition to playing with Lego-type toys, children also use a table or the floor for other play activities like painting, drawing, crafts, puzzles, and various other activities. Items on the market for child activities are children play tables and trays, toy tables, nursery tables, building boards, and construction tables. Some of these were designed specifically for use with interlocking building blocks (i.e., Mega-Build-n-Learn-Table), while others were designed for general playing. There are disadvantages to these items, listed as follows:

a. A primary area children use for play is their bedroom. Some rooms may be too small to comfortably fit the tables available on the market. Tables like U.S. Pat. No. D387583 (Shear) or U.S. Pat. No. D464089 (Studebaker) are examples of tables that may be too large or bulky for a smaller room. In many apartments and smaller homes every square foot counts and having a play table in a crowded room is not feasible. Being able to have a play platform that fits under the bed while not in use is a feature these tables lack and is a product benefit in a tight space.
b. Other patents or items on the market are tables and trays that may or may not have the ability for the legs to fold, can come with or without legs, or can be stored in a smaller space than a conventional play table when not in use. Products like these are U.S. Pat. No. 4,926,758 (Lilly, Moore, Eike, Barker); U.S. Pat. No. 4,872,410 (Lilly); U.S. Pat. No. 5,782,185 (Frahmm, Ryas); U.S. Pat. No. 5,218,912 (Buske); U.S. Pat. No. 5,327,838 (Beltman); U.S. Pat. No. 5,509,844 (Poirier); U.S. Pat. No. 5,615,619 (King) and U.S. Design Pat. No. D350, 247 (Buske) are all examples of these types of play tables or trays. Although these products are smaller than a usual play table, they may lack in providing movable implements to aid in sorting and grouping their toys while playing. Also, these tables and trays may be too small for larger Lego-like projects. For instance, when using Lego-type toys, the child typically sorts and groups different pieces while building and likes to be able to place them out of the way when not in immediate use. Or when painting, having a separate tray for paintbrushes, another for the water cup, and another tray for the paints that can be moved around as they choose would be an advantage to the user, but is lacking in the above referenced patents. Furthermore, these tables and trays may not fit under the bed or other piece of furniture, especially with an active project or other items on top of it. Additionally, convenient handles may not be placed on the above aforementioned tables.
c. Additionally, there are base plates on the market that have nubs and bumps or recesses to attach the Lego-type toys. U.S. Pat. No. 2,565,823 (Pool) is one of the earlier products, and there are others also that are more recent. These base plates do not provide storage capabilities, movable trays, handles, nor can they be used for other play activities outside of Lego-type toys. d. There are also items displayed throughout the Internet on various blogs for under bed Lego-type toy or other toy storage. They may include trundle-type drawers that take up a large amount of space under a bed that people can store all of their Lego-type toys in, or large Rubbermaid type containers for storage. Although these items can store very large amounts of toys and Lego-type toys, these are large storage devices, cannot be easily moved from room-to-room, and do not provide removable trays or bins for active playing. These are storage containers.

SUMMARY OF THE INVENTION

In accordance with one embodiment, the present embodiment relates to a play platform. Specifically, one embodiment having handles, removable bins, trays and drawers to aid in the play of many child activities. The removable bins and trays assist in play by providing a space to sort and group objects, and to store items. The low profile play platform can be used on a table or the floor and be stowed away under the bed with activity still intact when the child is finished with the play session. The light-weight play platform can also be moved to different rooms using the handles provided.

There are several possible embodiments of this play table. One is a play platform with trays and handles; another embodiment is a play platform with trays, handles, and bins; yet another embodiment is a play platform with trays, handles, bins, and drawers; and a fourth is a play platform with trays, handles, and drawers. Other embodiments and variations are possible and all are not mentioned in this summary.

DRAWINGS

Reference Numerals

Figure 1:
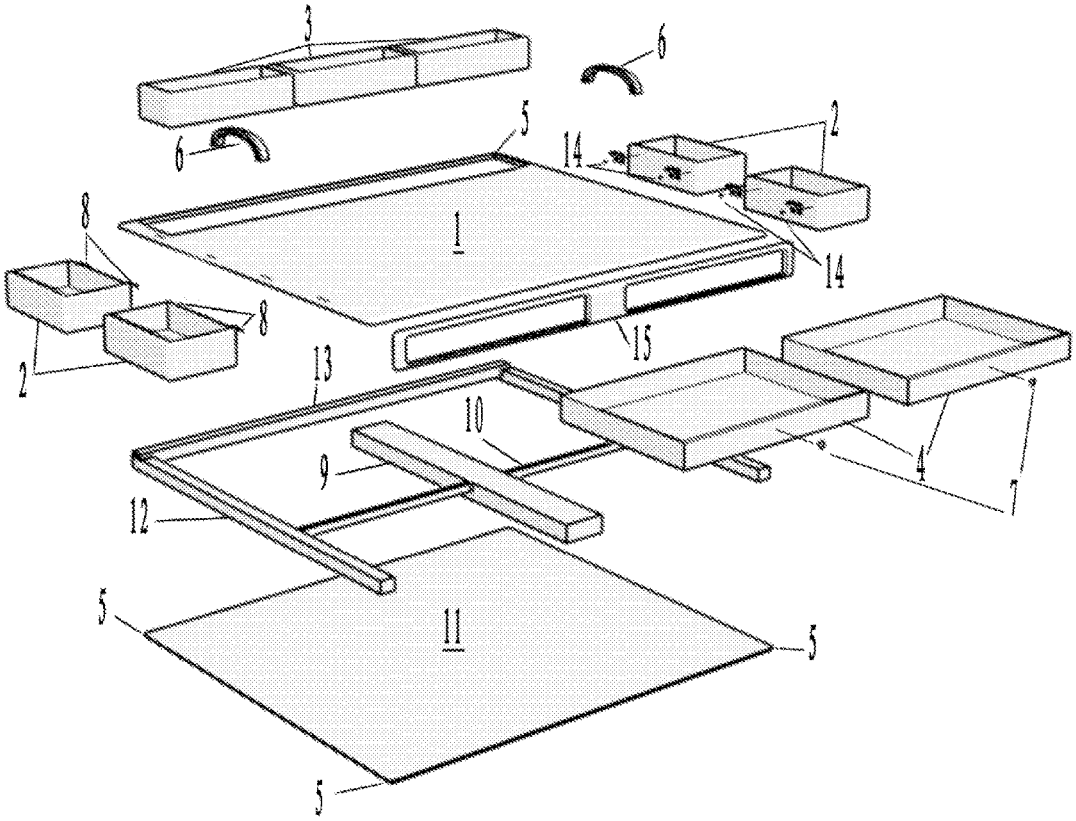
FIG. 1 is an exploded view of an exemplary play platform.
Figure 2:
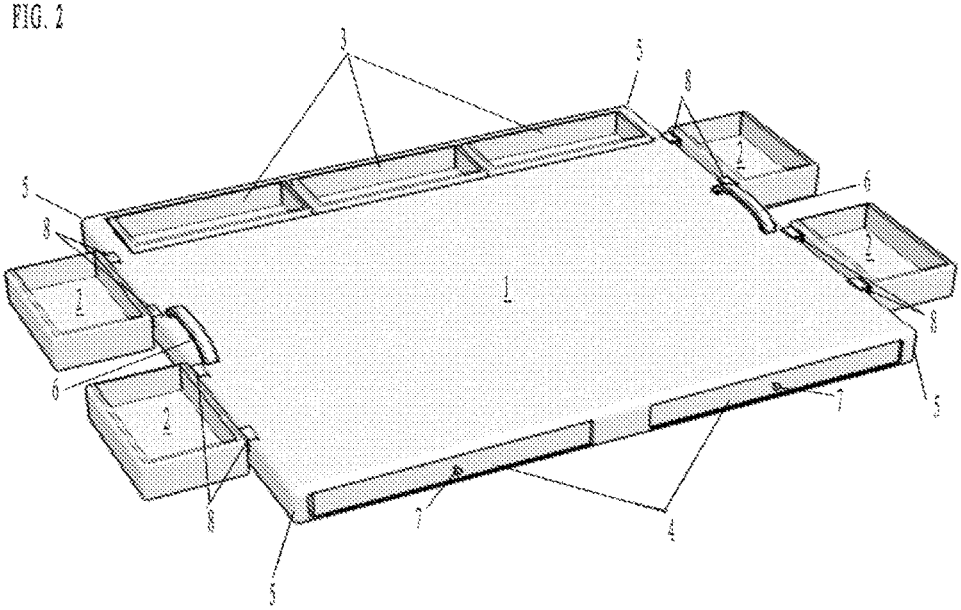
FIG. 2 is a perspective view of an exemplary play platform with drawers.

1 play platform
2 bins
3 trays
4 drawers
5 corner
6 handle
7 drawer knob
8 bin hook
9 center base
10 drawer stop
11 bottom
12 sides
13 back
14 screws
15 face plate

DETAILED DESCRIPTION

Embodiments of the present invention provide a play platform that is easily stored, easily moved, and easily organized, while preserving projects that are still in progress. The play platform can be used for a variety of play activities such as Lego-type building blocks, modeling clay, painting, puzzles, building models, and crafts, to name a few.

Advantages

1. The advantage of the present play platform is that it takes up little space in the home. The play platform can be stored under the bed or piece of furniture. This is especially useful for smaller rooms and spaces.
2. Another advantage of the present play platform is that it has many uses. It provides a solid platform for Lego-type toys and can also be used for other projects like painting, puzzles, modeling clay, and many other activities. It creates a neat and organized workspace that children can use for various projects and when placed under bed is completely hidden.
3. Yet another advantage of the present play platform is that it makes cleaning up easy and quick. When they are finished playing, the trays and bins can easily be placed back on the play platform and everything can simply be pushed under the bed while keeping their unfinished project completely intact and ready for their next play session. Since all play activity is done on the place surface, clean-up is very simple. This is great for parents that do not like a mess on the floor when their child is finished playing.
4. Yet another advantage of the present play platform is that is can be easily moved from room to room by an adult or older child using the handles provided.
5. Another advantage is that the present play platform can be made with more than one material. The play platform can easily be manufactured from a suitable conventional material such as wood or can be made with plastics, or other material.
6. Another advantage of the present invention is that when placed on the floor it cannot be tipped over by smaller children like conventional tables can.

FIG. 1 is an exploded view of an exemplary embodiment of a play platform. The legless, primary flat, or planar, rectangular platform may consist of the top and will be the primary play surface 1. In addition to the rectangular platform additional members may be included. The first member considered to be the front member 15 may be attached on edge and may be arranged at a 90 degree angle below the primary platform 1 and extend downward. This front 15 may have slots to accommodate drawers designated as 4 in FIG. 1. The front member may be attached to the primary platform 1 that runs along the width of the invention. The second member, considered one side of the invention 12, may be attached in like manner to the primary platform 1 as the first (front member. i.e. attached on edge and at 90 degrees to the primary) as well may be attached at a 90 degree angle to the front member without slots for drawers. The third member, considered to be the back 13 of the play platform may be attached in like manner as the front and side and is 90 degrees to the first side and parallel to the front also with no slots. The fourth member forms the second side 12, may be attached in like manner as the previous side descriptions and may be parallel to the second member, i.e. the first side 12 again with no slots. The four members when attached together form a rectangular shaped structure to which the primary flat member is attached. The means of attachment may be a combination of mortise and tenon joint supplemented with adhesive, e.g. glue, or other construction method. Therefore each side may be attached to the primary flat surface in addition to two of the sides. For example, the front 15 may be attached to the primary flat surface, the first side and the second side. Alternatively, the sides may be attached to one another using dovetail or other construction technique.

Removable bins 2 with bin hooks 8 to hang off of the primary play platform 1. Each bin 2 may attach along the periphery of the primary flat platform 1 for ease of access and secure storage. In the initial inception (embodiment), there may be four (4) of these bins 2. Each bin 2 may be constructed in identical manner and therefore may be interchangeable. The bins 2 may be constructed of a light weight flexible material, e.g. wood or plastic. Each bin 2 may be constructed using the same techniques as the overall platform 1 and sides, i.e. mortise and tenon, dovetail, or other construction technique along with adhesive or may be molded if plastic material is used for construction. Each bin 2 may be comprised of five (5) members; a bottom and four (sides). When fastened together four of the members will form a rectangle to which the fifth member, the bottom, will be attached. This will form and open topped box and bin. The first member of each bin may be connected to the second member using mortise and tenon, dovetail, or other construction method and may use an adhesive like glue. Each bin may have two (2) bin hooks 8 attached to fit into slots in the aforementioned primary play platform 1 in the present embodiment. These hooks may be equidistant on each bin 2 to allow maximum flexibility when attaching them to play platform 1. Future embodiments may have alternate methods of attaching one or more bins 2 to the primary platform. Bin 2 may come in different variations than shown.

Near the rear of the primary platform 1, may be a recessed cutout matching the size of a tray or trays, 3. These tray(s) 3 may be constructed in like manner as the aforementioned bins, but may not have "J" style bin hooks shown 8. They may simply place into the cutout in the primary platform 1 as described above. Trays 3 may be designed in different variations than shown. Trays 3 may place onto the primary platform 1 if primary platform 1 does not have a recession.

Drawers 4 that may slide into slots in the front member as described in 1 above. The face of the drawers 4 may have drawer knobs 7 to facilitate easy opening and closing. These drawers 4 may be constructed in like manner as the trays 3 and bins 2 as described above. These trays 3 may slide into slots in the front member of play platform 1. Each drawer 4 may have a knob or other handle like object on the front surface. The drawers 4 may extend in each slot to approximately half the distance towards the rear side of the play surface 1 and may interface with the drawer stop 10. Each drawer 4 may also slide along the Center Brace 9 as a drawer guide. Future embodiments may incorporate individual drawer stops and or drawer guides or be constructed in different ways not mentioned above.

These are the individual corners of the primary play surface 1. Each corner may be joined via combination of mortise and tenon joint supplemented with adhesive, e.g. glue or other method.

These are handles 6 located to each side on the primary play surface 1. They are generally semi-circular in shape, but may be other shapes that facilitate easy manipulation of the play surface 1. They may be attached, in general via screws 14 into the primary surface 1. Knobs/handles 7 may be attached to the front face of the drawers 4 as described in 4 via screws or other methods as warranted by the type of knob/handles. The handle may include an indentation and other embodiments known in the art for handling objects.

Bin Hooks 8. Each removable bin 2 may have two (2) "J" style or other bin hooks 8 attached via the most convenient method, e.g. screws 14 in some cases and may be spaced to allow the individual bins 2 to hang off of the primary play surface 1 from the corresponding slots. The hooks 8 may be evenly spaced to allow maximum flexibility of bin 2 placement. Each bin hook 8 may be constructed of the same material and may be metal, plastic, or other material. Future embodiments may use different ways to attach removable bins 2 to play platform 1 other than "J" style bin hooks 8 shown.

Center brace 9 of the primary play surface 1 may run along the width of the primary play surface 1 and may be consistent in size as each side member. The Center Brace 9 may be attached consistent with the style of attachment as each side as well as on the underside of the top, again consistent with each side 12. The Center Brace 9 may be constructed of the same material as the sides and primary play surface 1, or with other materials. Future embodiments may not incorporate a center brace, or may be constructed in different ways not mentioned above.

The Drawer Stop(s) 10 of the play surface 1 may be attached in the same manner as the Center Brace 9 and may be constructed of the same material. The Drawer Stops 10 may be positioned on the underside of the top of the play surface 1 and will provide a backstop for the drawers 4 of this embodiment. Exact location is dependent upon the size of the drawers 4. Each Drawer Stop 10 may also be attached to the Center Brace 9 as well as to the appropriate side 12 of the primary play surface 1. Future embodiments may incorporate individual drawer stops and or drawer guides or be constructed in different ways not mentioned above.

The Bottom 11 of the primary play surface may be constructed of the same material as the top 1 and may be attached to each of the sides 12, Center Brace 9 and Drawer Stops 10. The manner of attaching each member may be consistent with the rest of the construction or may be constructed in different ways not mentioned above.

The above embodiment shows the play platform with drawers and all removable components.

Operation—FIG. 1, 2, 4, 5, 6

The manner of using the play platform is similar to playing on any other surface. Namely, using handles 6 on the play platform 1; the user pulls the play platform 1 out from under a piece of furniture or bed when ready to engage in playtime activity. The user can play on the floor near the piece of furniture or bed, or use the handles 6 to carry the play platform to another room. The user may then place the new play activity on the play platform 1 or will continue prior activity utilizing play implements already on the play platform 1. Next, the user may use removable bins 2 and trays 3 to organize Lego-type building blocks, paints, modeling clays, or other toys by placing the said bins 2 and trays 3 closer to the user or further away from them until they are ready to use the pieces the removable bins 2 and trays 3 hold. The user may also use the drawers 4 for storage to remove items from or add items to that need to be used now or for future play sessions. The drawers 4 can be removed completely from the play platform 1 for additional playtime sorting or stay in the platform 1. Additionally, the user will build and play with activity on the play platform 1. When finished playing, the user then places all removed bins 2 and trays 3 back onto the play platform 1 and close or insert the drawers 4, if removed. The user may then use the handles 6 to push the play platform 1 under the bed or other piece of furniture. The play area is neat and clean and activity is ready for next play session.

Figure 3:
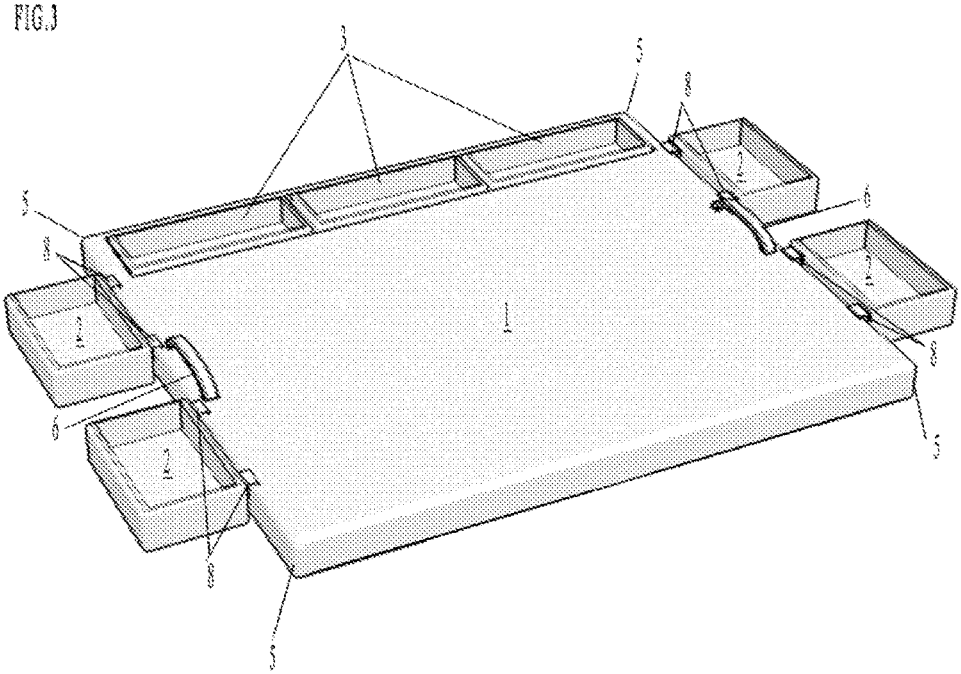
FIG. 3 is a perspective view of an exemplary play platform without drawers.
Figure 4:
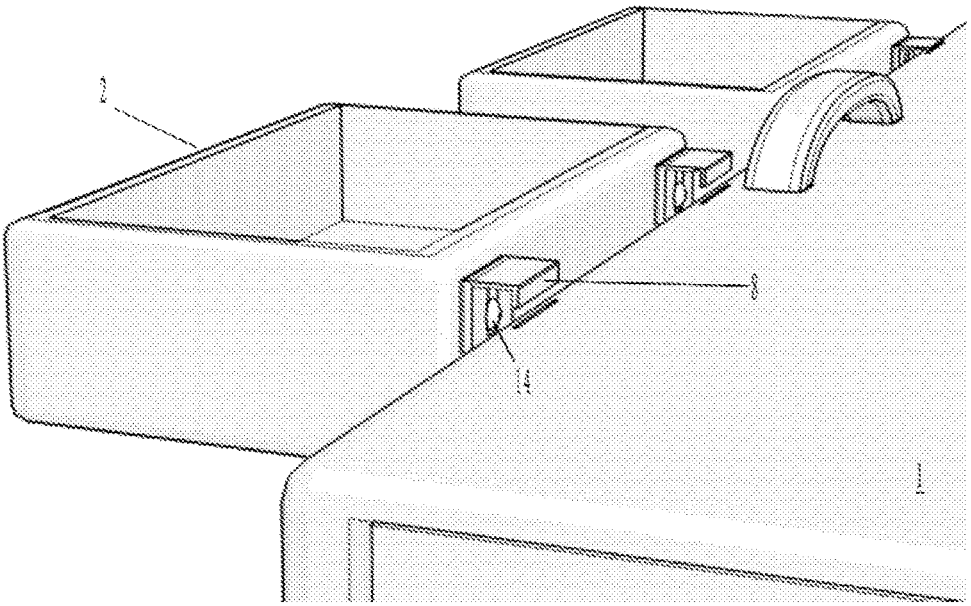
FIG. 4 is a detailed operational view showing how the bins attach to an exemplary play platform.
Figure 5:
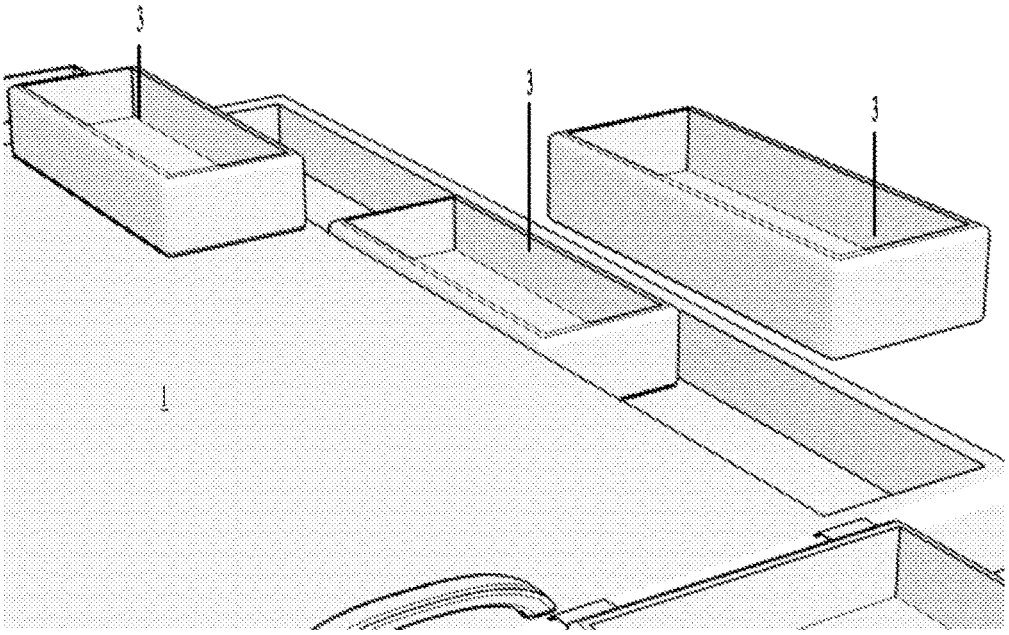
FIG. 5 is a detailed operational view showing how the trays sit in an exemplary play platform.
Figure 6:
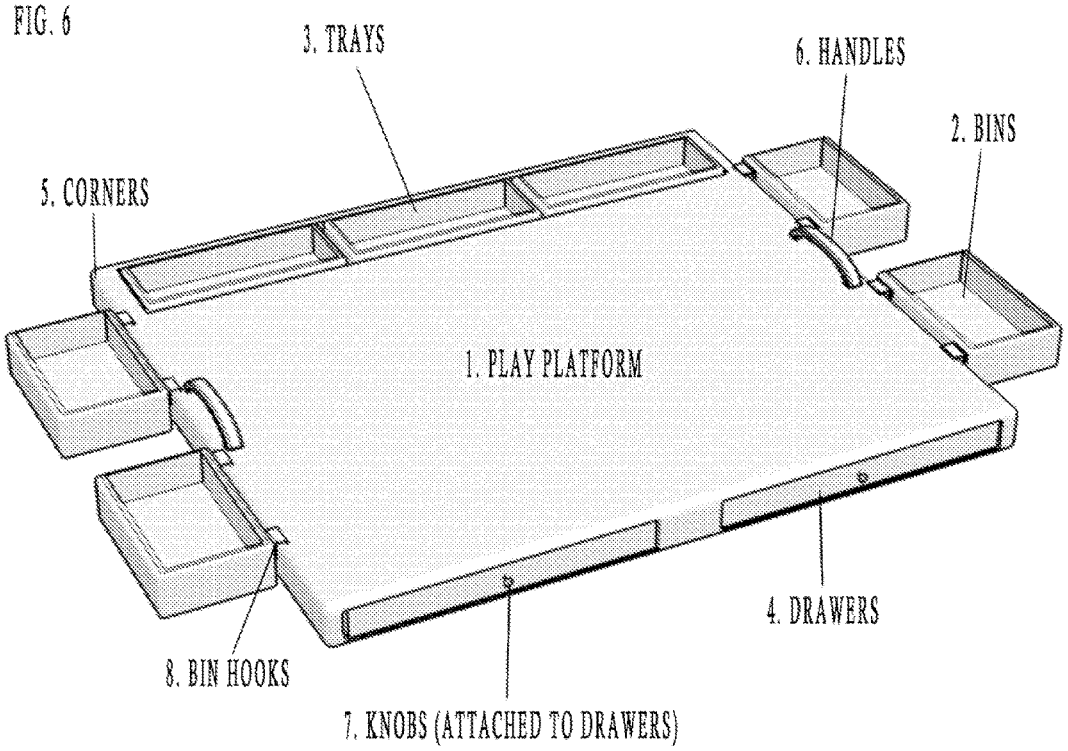
FIG. 6 is a view of play platform parts.

FIG. 3 is a perspective view of an embodiment of the play platform. The legless, primary flat, or planar, rectangular platform may consist of the top and will be the primary play surface 1 that may be constructed of one or more pieces of a light weight rigid material, e.g. wood or plastic.

Removable bins 2 with bin hooks 8 to hang off of the primary play platform. Each bin 2 may attach along the periphery of the primary flat platform 1 for ease of access and secure storage. In the initial inception (embodiment), there may be four (4) of these bins 2. Each bin 2 may be constructed in identical manner and therefore may be interchangeable. The bins 2 may be constructed of a light weight material such as wood, wood-like product, or plastic. Each bin 2 may be constructed using the same techniques as the overall platform 1 and sides 12, i.e. mortise and tenon, dovetail, or other construction method and may have adhesive or may be molded if plastic material is used for construction. Each bin 2 may be comprised of five (5) members; a bottom and four (sides). When fastened together four of the members may form a rectangle to which the fifth member, the bottom, may be attached. This will form and open topped box and bin 2. The first member of each bin may be connected to the second member using mortise and tenon, dovetail construction, or other method and may use an adhesive. Each bin 2 may have two (2) bin hooks 8 attached to fit into slots in the aforementioned primary play platform 1 in the present embodiment. These bin hooks 8 may be evenly spaced on each bin 2 to allow maximum flexibility when attaching them to play platform 1. Future embodiments may have alternate methods of attaching bins 2 to the primary platform 1 other than what is mentioned above.

Near the rear of the primary platform 1, may be a recessed cutout matching the size of a tray or trays, 3. These tray(s) 3 may be constructed in like manner as the aforementioned bins 2, but will have no bin hooks 8. They will simply place into the cutout in the primary platform 1 as described above. Trays 3 may be designed in different variations than shown. Trays 3 may place onto the primary platform 1 if primary platform 1 does not have a recession.

These are the individual corners 5 of the primary play surface 1. Each corner 5 may be joined via combination of mortise and tenon joint supplemented with adhesive, e.g. glue. These are handles 6 located to each side on the primary play surface 1. They are generally semi-circular in shape, but can be other shapes that facilitate easy manipulation of the play surface. They may be attached, in general via screws into the primary surface 1. The handle may include an indentation and other embodiments known in the art for handling objects.

Bin Hooks 8. Each removable bin 2 may have two (2) "J"-style or other bin hooks 8 attached via the most convenient method, e.g. screws in some cases and may be spaced to allow the individual bins 2 to hang off of the primary play surface from the corresponding slots. The bin hooks 8 may be evenly spaced to allow maximum flexibility of bin 2 placement. Each bin hook 8 may be constructed of the same material and may be metal, plastic, or other material. Alternative embodiments may use different ways to attach bins 2 to play platform 1 other than "J"-style bin hooks 8 shown.

Operation—FIG. 3, 4, 5

Using handles 6 on the play platform 1, the user pulls the play platform 1 out from under a piece of furniture or bed when ready to engage in playtime activity. The user can play on the floor near a piece of furniture or bed, or can use the handles 6 to carry the play platform 1 to another room. The user will then place the new play activity on the play platform 1 or will continue prior activity utilizing play implements already on the play platform 1. The user may then use the bins 2 and trays 3 to organize Lego-type building blocks, paints, modeling clays, or other toys by placing the bins 2 and trays 3 closer to the user or further away until they are ready to use the pieces the bins 2 and trays 3 hold. The user will continue to build and play with activity on the solid play platform 1. When finished playing, the user then places all removed bins 2 and trays 3 back onto the play platform 1 and uses the handles 6 to push the play platform 1 under the bed or other piece of furniture. The play area is neat and clean and activity is ready for next play session.

Additional Embodiment 1

Not Pictured

Additional embodiment, as in claim 1, is the play platform 1 without drawers 4 or bins 2. The legless, primary flat, or planar, rectangular platform may consist of the top and will be the primary play surface 1 that may be constructed of one or more pieces of a light weight rigid material, e.g. wood or plastic.

Near the rear of the primary platform 1, may be a recessed cutout matching the size of a tray 3 or trays, 3. These tray(s) 3 may be constructed in like manner as the bins 2, but will have no bin hooks 8. They may simply place into the cutout in the primary platform 1. Trays 3 may come in different variations than shown in figures and may be placed in the play platform 1 in a different way than mentioned above. Trays 3 may be designed in different variations than shown. Trays 3 may place onto the primary platform 1 if primary platform 1 does not have a recession.

These are the individual corners 5 of the primary play surface 1. Each corner 5 may be joined via combination of mortise and tenon joint supplemented with adhesive, e.g. glue, or other construction method. Additional construction methods may be plastic or other material.

These are handles 6 located to each side on the primary play surface 1. They are generally semi-circular in shape, but can be other shapes that facilitate easy manipulation of the play surface 1. They may be attached, in general via screws into the primary surface 1. The handle may include an indentation and other embodiments known in the art for handling objects.

Operation

Additional Embodiment 1

Using handles 6 on the play platform 1, the user pulls the play platform 1 out from under a piece of furniture or bed when ready to engage in playtime activity. The user can play on the floor near a piece of furniture or bed, or can use the handles 6 to carry the play platform 1 to another room. The user will then place the new play activity on the play platform 1 or will continue prior activity utilizing play implements already on the play platform 1. The user may then use the removable trays 3 to organize Lego-type building blocks, paints, modeling clays, or other toys by placing the trays 3 closer to the user or further away until they are ready to use the pieces the trays 3 hold. The user will continue to build and play with activity on the solid play platform 1. When finished playing, the user then places all removed trays 3 back onto the play platform 1 and uses the handles 6 to push the play platform 1 under the bed or other piece of furniture. The play area is neat and clean and activity is ready for next play session.

Alternative Future Embodiments

Not Pictured

With reference to FIGS. 1, 2, 3, and 6, an alternative embodiment of the play table is that all embodiments may have the ability to be connected together or produced in different sizes to accommodate larger play areas.

With reference FIGS. 1, 2, 3, and 6, another alternative embodiment of the play table is that all embodiments may fold up or for easy shipping and portability. In doing this, the play platform may have additional carrying handles attached or the handles may be removed or placed elsewhere on said platform.

With reference to FIGS. 1, 2, 3, and 6, a further alternative embodiment is that the structure may be manufactured and shipped in a plurality of pieces that may be snapped together.

With reference to FIGS. 1, 2, 3, 4, 5, and 6, yet another alternative embodiment of the play table is that all components may come in different styles and colors. This may include fabric covers for the trays and bins. Decorative plastic clings may also be available to further personalize the play platform.

With reference to FIGS. 1, 2, 3, 4, 5, and 6, another alternative embodiment of the play table is that all embodiments may also have a different variety of trays that can be changed out for different activities.

With reference to FIGS. 1, 2, 3, 4, 5, and 6, another alternative embodiment of the play table is that all embodiments may include any number of drawers and bins, including no drawers or bins.

With reference to FIGS. 1, 2, 3, 4, 5 and 6, in alternative embodiments, all components i.e., bins, trays, and drawers may be constructed in different sizes, shapes, and materials.

With reference to FIGS. 1, 2, 3, and 6, in alternative embodiments, the play platform may be constructed of one or more pieces of a light weight rigid material, e.g. wood or plastic.

The play platform may further include wheels or casters on a bottom surface of the play form to aid in sliding.

Additional Future Embodiments

Not Pictured

With reference to FIGS. 1, 2, 3, and 6, an additional embodiment of the play table is a method to secure a Lego-type toy base to the platform temporarily for ease of switching play-time activities.

With reference to FIGS. 1, 2, 3, and 6, another additional embodiment of the play table is that the trays and bins may have lids or other coverings on them which prevent spillage when transporting.

The play platform can be used to organize child activities during playtime and be stowed away neatly when finished while existing activities remain intact.

While the above description contains many specificities, these should not be construed as limitations on the scope of any embodiment, but as exemplifications of various embodiments thereof. Many other ramifications and variations are possible within the teachings of the various embodiments. For example, a simplified version of the play platform can also be appreciated that would include the play platform, removable trays, and handles. Further embodiments may include the addition of bins, yet additional embodiments may include drawers. Another embodiment may include any number of drawers and bins, including no drawers or bins. Also, the play platform and parts can come in different shapes and colors. Additionally, the means to attach the removable bins to the platform can be different than the way pictured or described. Accordingly, the scope should be determined by the appended claims and their legal equivalents.

From the foregoing discussion, various further improvements and or applications, modifications and or adaptations of the present invention that may or may not be implemented will now be expressly or inherently disclosed to those skilled in the art to which it pertains within the scope of the claims which follow. It is to be understood that all of the descriptions of the present invention contained in this document were, in all respects, strictly by way of nonlimiting example. It will be understood that the foregoing description is illustrative of the present embodiment and should not be considered as limiting and that other embodiments of the invention are possible without departing from the invention's spirit and scope, as embodied in the following claims.

The invention claimed is:

1. A play platform comprising:

a top flat play surface of rigid material, wherein the flat play surface includes a recess opening;

a legless, flat bottom surface of rigid material;

a structure comprising a plurality of members, each member extending from the top flat play surface to the flat bottom surface, resulting in a vertical profile of less than one foot; and at least one removable container connectable to a top side of the top flat play surface via placement in the recess opening of the top flat play surface, wherein the removable container obstructs at most a portion of the top side of the top flat play surface, and wherein a vertical profile of the removable container corresponds to the vertical profile of the structure when the removable container is placed in the recess opening of the flat play surface.

2. The play platform of claim 1, further comprising a bin that connects to the top side of the top flat play surface via an attachment mechanism that includes at least one hook, the at least one hook facing downward relative to an opening in the top of the bin, wherein the top of the play surface includes at least one hole that receives the at least one hook that connects the bin to the to the top side of the top flat play surface, and wherein the plurality of holes are rectangular shaped slots in the top side of the top flat play surface.

3. The play platform of claim 2, wherein the bin comprises a bin hook that fits into a slot on the top side of the flat play surface.

4. The play platform of claim 1, wherein the removable container is a tray.

5. The play platform of claim 4, wherein the recessed opening is a recessed cutout on the flat play surface and the tray fits into the recessed cutout on the flat play surface.

6. The play platform of claim 5, wherein the tray has a shape corresponding to the recessed cutout in the flat play surface.

7. The play platform of claim 1, further comprising one or more lids that attach to the removable container.

8. The play platform of claim 1, wherein the flat bottom surface further comprises one or more felt pads to aid in sliding.

9. The play platform of claim 1, wherein the play surface is constructed from a plurality of pieces.

10. The play platform of claim 1, further comprising a drawer that slides in between the play surface and the bottom surface.

11. The play platform of claim 1, further comprising a handle.

12. The play platform of claim 11, wherein the handle is an indentation in the flat play surface.

13. The play platform of claim 1, wherein the flat play surface is rectangular in shape.

14. The play platform of claim 1, wherein an edge of the removable container is substantially flush with the top flat play surface.

* * * * *